United States Patent [19]

Dirks et al.

[11] Patent Number: 4,629,840

[45] Date of Patent: Dec. 16, 1986

[54] DEVICE FOR QUENCHING AN ELECTRIC ARC

[75] Inventors: Rolf Dirks, Willich; Wolfgang Pehlken, Kempen, both of Fed. Rep. of Germany

[73] Assignee: Felten & Guilleaume Inergietechnik GmbH, Cologne, Fed. Rep. of Germany

[21] Appl. No.: 720,148

[22] Filed: Apr. 4, 1985

[30] Foreign Application Priority Data

Apr. 4, 1984 [DE] Fed. Rep. of Germany ..... 3412566

[51] Int. Cl.[4] ..... H01H 33/10

[52] U.S. Cl. ..... 200/147 R; 200/144 R

[58] Field of Search ..... 200/148 C, 148 G, 148 E, 200/144 R

[56] References Cited

U.S. PATENT DOCUMENTS 2,757,261 7/1956 Lingal et al. ..... 200/148 E 3,291,949 12/1966 Cromer ..... 200/148 C

FOREIGN PATENT DOCUMENTS 258395 11/1967 Austria ..... 200/144 R

*Primary Examiner*—Robert S. Macon

*Attorney, Agent, or Firm*—Michael J. Striker

[57] ABSTRACT

In an arc quenching device a quenching chamber filled with sulfur hexafluoride is provided with a plurality of superimposed overlapping ascending quenching plates having openings defining arc inlets. A movable contact cooperating with a stationary contact is insertable via the arc inlets into the quenching chamber.

5 Claims, 3 Drawing Figures

DEVICE FOR QUENCHING AN ELECTRIC ARC

BACKGROUND OF THE INVENTION

The present invention relates to a device for quenching an electric arc, usually provided on a switching apparatus of an electrically operated device.

Conventional arc quenching devices, such as magnetic arc quenching arrangements or devices for generating quencher gases or devices operated with the aid of compressors and storage containers have been usually very expensive and required a great deal of space.

The purpose of arc quenching devices is to quench an electric arc which occurs in switches upon switching them off or breaking a circuit. Such electric arcs often occur during the opening of contacts due to steaming of the last metallic bridges, caused by joulean heat. In circuit breakers and power control switches such arcs must be extinguished as fast as possible, and a sufficient insulation must be established between the contacts. If in the case of direct current flowing through the circuit of the switch a great arc voltage should be reached in the switching chambers, in the case of alternating current an effective load carrier between a zero current and a recovery voltage must be obtained in a short time. This substantially depends on the type of the switch and on whether an ultimate current interruption takes place in one or a number of zero passages. It is, however, important that an electric arc be sufficiently cooled down.

Various means have been utilized for quenching arc between two normally open contacts. It has been known that in order to quench switch arcs magnetic fields in switching chambers have been used and cooling down has been obtained on respectively designed arc-resistant walls of the chambers.

Circuit breakers for average voltage which operate in accordance with the above described method have required comparatively large quenching chambers and have been therefore rather expensive.

Switches operated with medium and high voltage devices have been used, in which an intensive gas stream is generated to cool the zone where the arc occurs. With this method it can be provided that the quenching gas stream would be produced by the switch itself. A switch which operates in accordance with such principle is disclosed in EP-OS 0,068,951. In other conventional devices the quenching gas is brought to a required pressure by means of compressors and stored in containers. However, both means for arc quenching are considerably expensive.

SUMMARY OF THE INVENTION

It is an object of the present invention to provide an improved arc quenching device.

It is another object of this invention to provide an arc quenching device for a switch operated in the range of average and high voltage and which would be more efficient and less expensive as compared to conventional arc quenching devices of the foregoing type.

These and other objects of the present invention are attained by an arc quenching device for a switch of an electrically operated apparatus, including a quenching chamber filled with sulfur hexafluoride or a mixture containing sulfur hexafluoride, at least one stationary contact member and at least one movable contact element cooperating with said contact member and insertable into said quenching chamber, the improvement comprising a plurality of quenching plates arranged on said chamber and cooperating with said movable contact element.

The quenching plates may be arranged on said chamber so that they extend parallel to a movement of said contact element, which at least partially coincides with a direction of magnetic field of the arc.

The advantage of this invention resides in that, due to the provision of overlapping quenching plates the size of the quenching device can be substantially reduced. Furthermore, the whole quenching device can be, without any efforts, installed into an existing switch system.

The quenching plates may be each made of sheet steel, said chamber being enclosed by walls made of electrically-insulating material.

The device may further include a bus bar connected to said stationary contact member, said quenching plates being electrically insulated from each other, from said contact member and contact element and from said bus bar.

The quenching plates may be arranged so that they overlap each other so that a magnetically split-up arc is limited by a non-interrupted cooling surface.

The quenching plates may extend between said walls, each of said plates having an opening, said plates superposing and overlapping each other so that a distance from an end of said movable contact element to the openings of said plates increases with a rising moving of said movable contact element.

The device may further include two support elements connected to said walls, said support elements being formed of one piece with said chamber and arranged in the proximity of said stationary contact member.

The quenching plates may be formed of metal and coated with a metallic layer of a material different from said metal.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
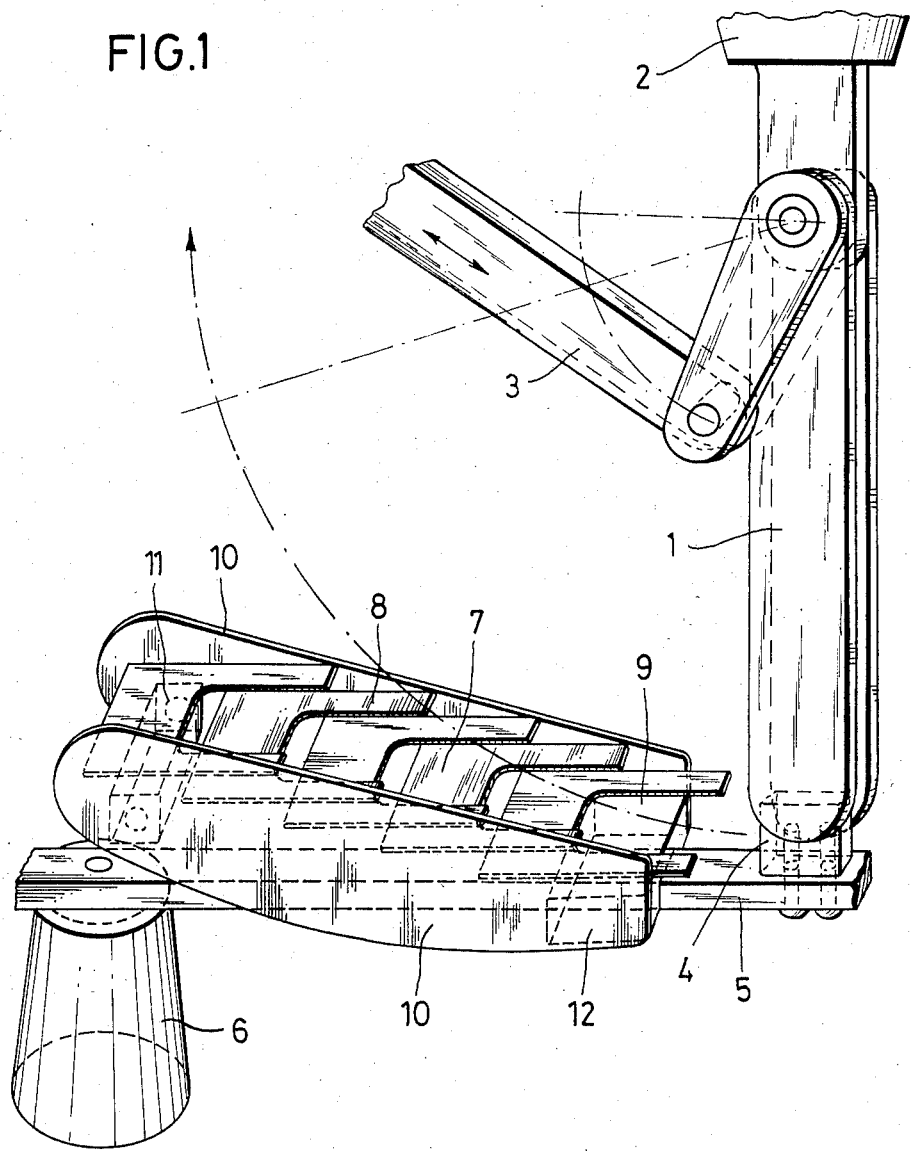
FIG. 1 is a perspective view of an electric arc quenching device for a switch arrangement.

Referring now to the drawings in detail, FIG. 1 shows a portion of a switching apparatus which is formed herein as a double cutting, electrically operated knife and includes a contact element 1, a pivot axis of which rests on a through guide 2. The contact element is formed of two parallel plates spaced from each other and receiving a pivot 20. The movable contact element 1 is connected to a coupling rod 3 of a drive by a link 22. A stationary contact piece 4 forms a counter element for the movable contact element 1. Contact piece 4 is rigidly connected, for example by bolts, to a bus bar 5. A plug connector 6 of any suitable conventional design serves for receiving the bus bar 5. The movement of the coupling rod 3 connected to any suitable conventional drive, is indicated by arrow A. The pivoting movement of the end of the movable contact element 1 is indicated by arrow B.

Figure 2:
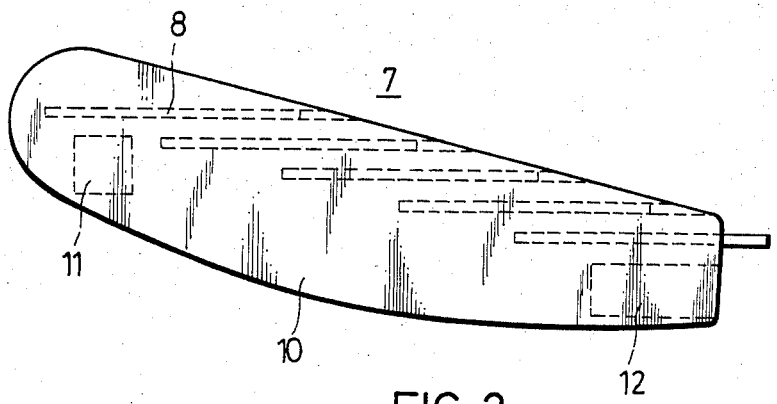
FIG. 2 is a side view of the electric arc quenching device.
Figure 3:
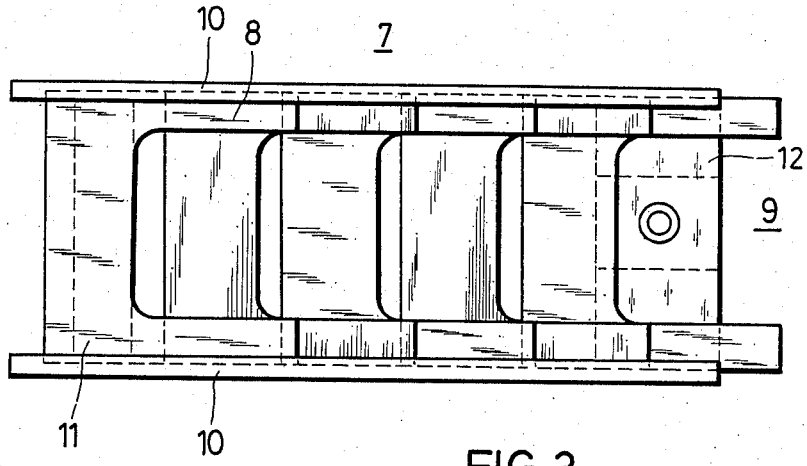
FIG. 3 is a top plan view of the electric arc quenching device.

The electric arc quenching device illustrated in figures 1 through 3 includes a quenching chamber 7, which is filled as known with sulfur hexafluoride or a mixture containing sulfur hexafluoride and provided with a plurality of parallel and overlapping quenching plates 8. Due to the parallel and overlapping arrangement of the quenching plates 8 a number of electric arc inlet openings or recesses 9, directed towards the movable contact element 1, results. The electric arc entrance openings 9 are arranged so that the distance between the end 25 of the movable contact element and individual electric arc entrance openings increases from one such opening to another. The individual quenching plates 8 are enclosed by means of walls 10 of the quenching chamber 7. Supports 11 and 12, made of plastics or similar which extend transverselly of walls 10, are provided for the connection of these two opposite walls to each other. The support 12, made out of plastics, further serves for securing the quenching chamber to the bus bar or rail 5.

Each quenching plate 8 is made of sheet steel while the walls 10 of the quenching chamber are made out of insulation material.

Quenching plates 8 are electrically insulated from each other, from the contact members 1 and 4 and from the bus bar 5.

It will be understood that each of the elements described above, or two or more together, may also find a useful application in other types of arc quenching devices differing from the types described above.

While the invention has been illustrated and described as embodied in an arc quenching device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an arc quenching device for a switch of an electrically operated apparatus, including wall means defining a quenching chamber filled with sulfur hexafluoride or a mixture containing sulfur hexafluoride, at least one stationary contact member and at least one movable contact element cooperating with said stationary contact member and insertable into said quenching chamber, and a plurality of quenching plates arranged in said chamber and cooperating with said movable contact element, said quenching plates being electrically insulated from each other and from said contact members, the improvement comprising said quenching plates being made of sheet steel, said wall means being made of electrically-insulating material, said quenching plates being inserted into said chamber such that they all extend parallel to the direction of movement of said movable contact element, which at least partially coincides with a direction of magnetic field of an electric arc being quenched.

2. The device as defined in claim 1, wherein said wall means include walls enclosing said chamber; and further including two support elements connecting said walls to each other, and a bus bar connected to said stationary contact member, one of said support elements being connected to said bus bar in the proximity of said stationary contact member.

3. The device as defined in claim 2, wherein said quenching plates overlap each other so that a magnetically split-up arc is limited by a non-interrupted cooling surface.

4. The device as defined in claim 2, wherein said quenching plates extend between said walls, each of said plates having an opening, said plates superposing and overlapping each other so that a distance from an end of said movable contact element to the openings of said plates increases with a rising movement of said movable contact element.

5. The device as defined in claim 1, wherein said quenching plates are coated with a metallic layer of a material different from a metal of the quenching plates.

* * * * *